US011700961B2

(12) United States Patent
Taylor

(10) Patent No.: US 11,700,961 B2
(45) Date of Patent: Jul. 18, 2023

(54) HANGING DEVICE AND ASSEMBLY

(71) Applicant: The Janger Limited, London (GB)

(72) Inventor: Guy Taylor, London (GB)

(73) Assignee: THE JANGER LIMITED, London (GB)

( * ) Notice: Subject to any disclaimer, the term of this patent is extended or adjusted under 35 U.S.C. 154(b) by 581 days.

(21) Appl. No.: 15/111,651

(22) PCT Filed: Jan. 14, 2015

(86) PCT No.: PCT/GB2015/050067
§ 371 (c)(1),
(2) Date: Jul. 14, 2016

(87) PCT Pub. No.: WO2015/107341
PCT Pub. Date: Jul. 23, 2015

(65) Prior Publication Data

US 2016/0331170 A1 Nov. 17, 2016

(30) Foreign Application Priority Data

Jan. 14, 2014 (GB) ..... 1400549

(51) Int. Cl.
*A47G 25/28* (2006.01)
*A47G 25/48* (2006.01)
*A47F 5/00* (2006.01)

(52) U.S. Cl.
CPC ..... *A47G 25/28* (2013.01); *A47F 5/0006* (2013.01); *A47G 25/48* (2013.01)

(58) Field of Classification Search
CPC ..... A47G 25/743; B65D 73/0064
USPC ..... 223/87, 91, 93, 96
See application file for complete search history.

(56) References Cited

U.S. PATENT DOCUMENTS 1,295,480 A 2/1919 Grant
1,674,043 A * 6/1928 Hoffman ..... A47G 25/20 223/91
2,492,226 A 12/1949 Kohl et al.
(Continued)

FOREIGN PATENT DOCUMENTS

DE 202005012669 U1 12/2005
EP 0 387 112 A1 9/1990
(Continued)

OTHER PUBLICATIONS

Fixtures Close Up; Belt Loop Hangers For Jeans in Retail; Dec. 7, 2010; www.fixturescloseup.com/2010/12/07/belt-loop-hangers-jeans/. *
(Continued)

*Primary Examiner* — Nathan E Durham
(74) *Attorney, Agent, or Firm* — Renner, Otto, Boisselle & Sklar, LLP

(57) ABSTRACT

A garment hanger comprising a rail engaging portion and garment supporting means in the form of a deformable elongate member. The end of the elongate member distal from the rail engaging portion comprises a first part of a connection mechanism such that the elongate member can be deformed back upon itself and connected to a second part of the connection mechanism of the hanger to form a closed loop. The hanger further comprises an aperture for attaching the hanger to the garment.

17 Claims, 3 Drawing Sheets

(56) References Cited

U.S. PATENT DOCUMENTS 2,648,471 A * 8/1953 Helwig ..... A47G 25/481 223/96
2,723,064 A * 11/1955 Rose ..... A47G 25/485 223/91
3,744,685 A * 7/1973 Hart ..... A47G 25/28 223/96
3,790,045 A 2/1974 Rigel et al.
4,266,677 A * 5/1981 Dewsnap ..... A47F 5/0006 211/113
D297,285 S * 8/1988 Larsson ..... D32/64
4,826,056 A * 5/1989 Duester ..... A47G 25/485 223/96
4,884,726 A * 12/1989 Kolton ..... A47G 25/28 223/91
4,943,026 A * 7/1990 Fildan ..... B65D 25/22 24/561
5,011,054 A 4/1991 Mauffette
5,013,004 A * 5/1991 Wilkins ..... B65B 61/14 206/806
5,072,866 A * 12/1991 Kolton ..... A47G 25/28 223/85
5,193,676 A * 3/1993 Gold ..... B65D 85/18 40/664
5,261,580 A * 11/1993 Smith ..... A47G 25/28 206/480
5,413,301 A * 5/1995 Cadman ..... B65D 73/0071 211/113
5,626,268 A * 5/1997 Kolton ..... A47G 25/743 223/85
5,975,384 A * 11/1999 Manabat ..... A47G 25/485 223/91
6,036,064 A * 3/2000 Tawil ..... A47G 25/1407 223/85
6,299,039 B1 10/2001 Hsu
6,497,347 B1 * 12/2002 Feibelman ..... A47G 25/743 223/85
6,612,494 B1 9/2003 Outwater
7,886,945 B2 * 2/2011 Fitzgerald ..... A47F 5/0006 223/85
8,985,408 B2 * 3/2015 Lloyd ..... H01F 7/0252 223/91
D769,005 S * 10/2016 Kay ..... D6/319
2002/0104858 A1 * 8/2002 Woodworth ..... A47G 25/483 223/85
2002/0129629 A1 9/2002 Su
2008/0245827 A1 * 10/2008 Peyser ..... A47F 7/19 223/91
2011/0031286 A1 2/2011 Gouldson
2015/0060501 A1 * 3/2015 Trusiak ..... A47G 25/485 223/91

FOREIGN PATENT DOCUMENTS

EP 0 875 188 A2 11/1998
FR 2 436 453 A1 4/1980
FR 2 604 883 A1 4/1988
FR 2 609 613 7/1988
GB 2 252 902 A 8/1992
GB 2 364 272 A 1/2002
GB 2 474 314 A 4/2011
GB 2474329 A 4/2011
GB 2485391 A 5/2012
JP 2003-93793 A 4/2003
WO WO-2011086376 A1 * 7/2011 ..... A47G 25/005

OTHER PUBLICATIONS

International Search Report and Written Opinion for corresponding Patent Application No. PCT/GB2015/050067 dated Aug. 25, 2015.

* cited by examiner

HANGING DEVICE AND ASSEMBLY

This application is a national phase of International Application No. PCT/GB2015/050067 filed Jan. 14, 2015 and published in the English language, which claims priority to United Kingdom Application No. GB 1400549.0 filed Jan. 14, 2014, which are hereby incorporated herein by reference in their entirety.

FIELD OF THE INVENTION

This invention relates to an improved hanging assembly or arrangement, especially for use with clothing and in particular jeans, shorts and trousers. The invention includes a hanger adapted for connection to a garment independently from hanging the garment, a hanging attachment for holding part of a garment and a connector arrangement for connecting the hanger to a garment.

BACKGROUND TO THE INVENTION

Hangers for clothing are generally labelled to show the size of the garment that should be attached to that particular hanger. Whilst labels are also often attached to the garment itself, these can be difficult to see quickly and can fall off.

A problem with existing hanging devices is that when the clothing garment is tried on by potential customers, the hangers are removed and they frequently get mixed up so that the next person to try on the garment may be misled as to the size of the garment that they are trying. As a result the seller may miss out on the customer purchasing the garment because the customer believe that the garment does not fit. However, the hanger needs to be readily removable so that a customer can try on the garment before they purchase it, without the hanger interfering with the look of the garment.

In stores, trousers and jeans are often folded and displayed on a shelf or table, or they are put on over a trouser hanger, which comprises a slot between two substantially horizontal bars through which the garment is threaded once it has been folded in half longitudinally. In the latter case, the garment has to be fed through an aperture on the hanger and it is displayed in a folded position. Such a method of hanging has an advantage over displaying the garment at full length because it takes up less vertical hanging space. However, that method of hanging creates undesirable creases in jeans and is not a flattering way to display the item. The vertical space taken up by a garment is often called the 'drop height' and by reducing the drop height, more garments can potentially be displayed in a given vertical space. Additionally, some rails are set to a predetermined height and reducing the drop height allows longer items to be hung on those rails.

When the garment is tried on by a customer, it takes some time to rehang the garment and when such a process is rushed, the garment is often not folded properly and looks messy. Such a messy appearance can reduce potential sales and damage stock. In some stores, staff can be rehanging garments for a considerable period of time each day. Therefore, there is a need to reduce the time taken to rehang a garment but with a reduced drop height.

Whilst hangers have been proposed that connect to a garment through a belt loop and stay connected when tried on, such hangers can be problematic when threaded through a plurality of belt loops.

SUMMARY OF THE INVENTION

Accordingly, a first aspect of the present invention is directed to a garment hanger comprising a rail engaging portion and garment supporting means in the form of a deformable elongate member, the end of the elongate member distal from the rail engaging portion comprising a first part of a connection mechanism such that the elongate member can be deformed back upon itself and connected to a second part of the connection mechanism of the hanger to form a closed loop, wherein the hanger further comprises an aperture for attaching the hanger to a garment.

Providing an aperture in the body of the hanger allows for it to be readily connected to a garment independently from the garment engaging portion. The use of a hanger with a deformable elongate member allows for the hanger to be readily and easily connected to the garment and/or a loop thereon and for the hanger to be readily disengaged from the garment.

Preferably, when the connection member is in a deformed state, a substantially flat spacer is defined at the intended lower end of the loop. This reduces stress on the connection member and also reduces the risk of the garment becoming damaged or deformed when hung by the hanger. Additionally, the flat spacer allows the garment to be displayed in a more controlled manner due to it being held in a more limited manner.

Advantageously, the elongate member is substantially the same width along its length and that width is less than the span of the rail engaging portion and wherein the elongate member comprises at least two predetermined weakened regions along which the elongate member deforms to form the loop and define the spacer. The elongate member being substantially straight and having a substantially constant width allows it to more easily engage the belt loop, opposed to having a contoured length that may catch or be difficult to thread through a belt loop. Whilst it could be tapered, converging distally, this may reduce its strength.

The invention extends to a garment hanger assembly comprising the hanger and attachment means for attaching the hanger to the garment and retaining it thereupon. Preferably, the hanger is a hanger as abovementioned. The attachment means connect the hanger to the garment in a substantially unreleasable, or semi-permanent, manner, independently from the garment engaging part of the hanger. Although one may wish to use a substantially releasable attachment means, it is preferable that the attachment means are substantially non-releasable so that the hanger is attached to the garment until a customer purchases the item of clothing. This way, the size guide, which may be attached to the hanger, is held on the garment until it is purchase and the risk of mixing hangers, and therefore attaching the wrong size guide, is reduced. Additionally, where a number of garments have been jumbled together, it is quicker and easier to hang the garment because the hanger is attached in a known position so the person rehanging the garments does not need to find hangers and put them on the correct garment; the hanger is already provided and merely needs hooking back onto the garment. The aperture can be positioned in the material of the hanger as a hole therethrough.

The hanger may be attached to the garment before leaving the garment manufacturing plant. Alternatively, it may be attached in-store or at a processing location.

Preferably, the attachment means comprise a rigid or flexible tie, and more preferably, where the tie is a flexible tie, it comprises an item selected from a group comprising: a kimble tag; a chain; string; wire; and ratchet-and-tooth device. The use of a flexible tie reduces the risk of the garment being damaged should the hanger be tugged or caught. Kimble tags are readily used in stores and can be used to attach the hanger to the garment as well as any labels. Chains, strings, wires and ratchet-and-tooth devices, also referred to as "cable ties", might be used to substantially permanently connect the hanger to the garment until the garment is purchased. The hanger can then be released at the checkout by cutting or disengaging the tie, or it may be retained on the garment until the customer removes it once they have left the store. The tie may be in the form of a closed loop that passes through the garment, particularly a loop upon the garment such as a belt loop, or it may be in the form of a straight, non-looping tie. Where a tie is used that comprises a non-looping tie, it is preferable that the ends of that tie are wider than the body to avoid it passing through the hanger or garment and disengaging.

In a particularly advantageous embodiment, the tie passes through the aperture in the hanger and connects to the garment. Providing the hanger with an aperture and feeding the tie therethrough is a quick and easy way to connect the hanger to the garment. The tie may be in the form of a loop so that it passes through the hanger and a loop on the garment, or through the material of the garment, and connects to itself so that it doesn't come away. Alternatively, the tie may be in the form of a length of material with a stopper at each end, for example barbs, knots or extensions on each end, similar to a kimble tag. The use of a hanger comprising a flat spacer provides a convenient position for the garment to rest and allows the tie to be more easily positioned using one hand without the garment moving around.

In one embodiment, the hanger, the attachment and the means for attaching the hanger to the garment are all used in combination. This provides a hanger attached to a garment and means for reducing the drop height.

Where a hanger is used in which an elongate member is provided, the span of the rail engaging means may be greater than that width of the elongate member. This allows the hanger to be easily threaded through a belt loop on the garment and the hanger suspended from a rail or other support.

The present invention is particularly advantageous when used in combination with the hangers disclosed in United Kingdom patent numbers GB2474314 and GB2474329. It should be noted that the hangers discloses in those patents are intended to be passed through a single belt loop and remain attached to the garment whilst the garment is tried on.

The invention extends to a method of hanging a garment comprising the steps of: providing a hanger in accordance with the present invention;

threading the hanger through a plurality of loops on the garment;

closing the hanger; and providing attachment means to attach the hanger to the garment independently from the elongate portion.

The use of the attachment means allows the hanger to disengage the plurality of loops without the hanger becoming complete detached from the garment. This ensures that even when the hanger is removed for trying on the garment, the hanger is still readily available for use with the garment.

The invention extends to a hanger attachment comprising a connection aperture and gripping section, whereby the aperture is adapted to engage a hanger and the gripping section is adapted to engage a garment hung on the hanger. An aperture is provided to connect the attachment to a hanging device and the gripping section allows the garment to be held by the hanger itself and also by the attachment, simultaneously. This provides the user with the ability to reduce the drop height of an item by placing two parts of the garment at a similar height; one on the hanger and one engaging the gripping section of the attachment.

For example, on jeans, the hanger may connect to the waistband of the jeans and the attachment can grip the legs of the garment. Therefore, when viewed from the side, the jeans may have an N-shaped profile or a U-shaped profile. This allows for a reduced drop height and so can potentially allow for more garments to be hung in a set vertical space. Additionally, because the legs of the jeans do not need to be threaded through the hanger, it is quicker to connect them to the attachment than rehanging them on a traditional trouser hanger.

Furthermore, a clip hanger or a hanger with a looped portion can be used with the attachment, which improves the appearance of the garment in-store over a trouser hanger for casual lower body wear. The connection aperture could be in the form of a hook portion, but a closed aperture, or hole, is preferable. The connection aperture may be connected to a further object before connecting to the hanger, for example, a flexible spacer may be used but, ultimately, the attachment is connected to the hanger.

The connection aperture of the garment hanger attachment may be in the form of a slit or elongate hole to allow the attachment to be connected to a hanger. The overall width of the hanger attachment is, preferably, less than 150 mm, and more preferably, less than 100 mm. This results in the attachment being relatively narrow and thus requiring less space and material. Additionally, the hanger attachment is preferably less than 200 mm in length, and, more preferably, less than 150 mm or less than 100 mm in length.

Preferably, the gripping section comprises a back-plate and a tongue. Using a tongue and back-plate system, whereby the tongue is a yieldable structure that then presses against a back-plate to grip an article held therebetween, provides a reliable and relatively strong mechanism for retaining a part of a garment. The back-plate may be solid or it may comprise a boarder or surround with an aperture therein, wherein the tongue passes through the aperture such that a garment is clipped between the tongue and the surround.

Advantageously, the back-plate and/or the tongue comprises teeth to assist with retaining the garment in the gripping section. The use of angled teeth allows the garment to be directed into the gripping section easily and makes it more difficult to remove from the attachment. Where both the back-plate and the tongue are provided with teeth, the device becomes particularly reliable at gripping the garment, due to the 'biting' nature of the gripping section.

It is preferable that the back-plate comprises a boarder and an aperture therewithin. The back-plate may not be a solid section and may be shaped as per particular requirements. For example, removing material may make the manufacturing process easier and reduces the amount of materials required, thereby reducing the weight and cost of manufacture. Therefore, the back-plate may be a boarder with a gap under the tongue but that still assists with gripping any garment placed in the attachment by clipping or pinching the garment between the tongue and surround. An advantage of having an aperture in the back plate is that the gripping portion may be aligned to have a rest position wherein the end of the tongue extends beyond the rear of the hanger. This increases the gripping force provided by the tongue when engaging a garment.

The invention extends to a garment hanger assembly comprising a garment hanger and a hanger attachment as described above, wherein the hanger engages the hanger attachment via the connection aperture. The assembly allows a user to connect a hanger to the hanger attachment via the connection aperture and it allows for a reduction in the drop height of the garment by having the hanger and the attachment both grip and/or engage the garment.

In a preferred embodiment, the hanger comprises a rail engaging portion and a deformable elongate member, the end of the elongate member distal from the rail engaging portion comprising a first part of a connection mechanism such that the elongate member can be deformed back upon itself and connected to a second part of the connection mechanism of the hanger to form a loop. Such a type of hanger is particularly useful for hanging jeans, shorts and casual trousers and when combined with the elongate member, which passes through the connection aperture, a garment can be displayed with a reduced drop height. The hanger may pass through a belt loop or other loop on the garment. The hanger may be in the form of a garment hanger comprising a rail engaging portion and garment supporting means in the form of a deformable elongate member, the end of the elongate member distal from the rail engaging portion comprising a first part of a connection mechanism such that the elongate member can be deformed back upon itself and connected to a second part of the connection mechanism of the hanger to form a closed loop, wherein the hanger further comprises an aperture for attaching the hanger to the garment. When the connection member is in a deformed state, a substantially flat spacer may be defined at the intended lower end of the loop. The elongate member may be substantially the same width along its length and that width may be less than the span of the rail engaging portion. Additionally, the elongate member may comprise at least two predetermined weakened regions along which the elongate member deforms to form the loop and define the spacer.

Advantageously, when the connection member is in a deformed state, a substantially flat spacer is defined at the intended lower end of the loop. Using a hanger with a flat spacer in the loop allows one to position the garment and the attachment at the same level without deforming the item of clothing or damaging it. The connection mechanism may be releasable or non-releasable.

It is further advantageous that the elongate member comprises at least two predetermined weakened regions along which the elongate member deforms to form the loop and define the spacer. Providing two weakened regions allows the elongate member to deform and create the spacer at a known position. Additionally, the use of a third weakened region reduces the strain on the connection member by increasing the flexibility of the elongate member, thereby reducing the force on the connection member. Bearing in mind that the weight of clothing may increase the strain on the hanger, especially the connection member, having the weakened regions allows the strain to be more controlled and the hanger less likely to fail.

Preferably, in use, the hanger is attached to the hanger attachment and the garment and the hanger attachment also engages the garment. This reduces the drop height and allows one to hold the garment in a secure way that also creates a neat and tidy display, whilst presenting the garment in a stylish manner.

The invention further extends to a hanger comprising a material that fluoresces under ultraviolet radiation. The material may be incorporated into the plastics material of a hanger or may be applied post-manufacture of the hanger, for example by applying fluorophore or another compound, material, ink, dye, paint or coating that will fluoresce, or glow, under UV radiation, for example, black light. The fluorophore may be applied to a part that is bonded to the hanger. The material that fluoresces should be permanently attached so that it cannot be readily removed. Such a hanger is thus provided with a security feature that is easy and cost-effective. A UV light can be provided against an array of hangers and those provided with the fluorophore or other fluorescing material will glow, whilst those without will not. Because the coating is effectively invisible in the human visual range and only appears under stimulation with wavelengths in the ultraviolet range, the overall appearance of the hanger is no different to a user or a customer. This allows one to readily identify unauthorized hangers.

Preferably, the hanger the hanger comprises a rail engaging portion and a deformable elongate member, the end of the elongate member distal from the rail engaging portion comprising a first part of a connection mechanism such that the elongate member can be deformed back upon itself and connected to a second part of the connection mechanism of the hanger to form a loop. More preferably, when the connection member is in a deformed state, a substantially flat spacer is defined at the intended lower end of the loop, and more advantageously, the elongate member comprises at least two predetermined weakened regions along which the elongate member deforms to form the loop and define the spacer.

In the present invention, it is preferably that the hanger attachment herein described is applied to the garment hanger of the present invention. In such an embodiment, it if advantageous that the hanger attachment is applied to the elongate member of the garment hanger.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1A:
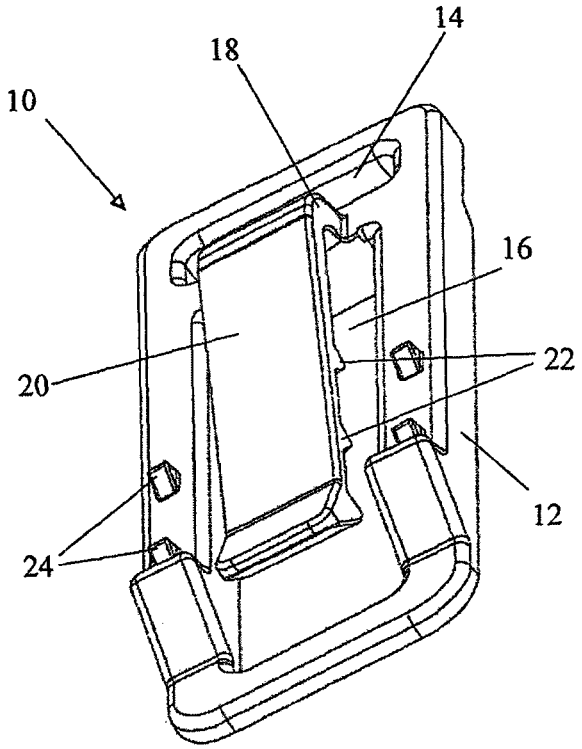
FIG. 1*a* is a diagram showing an isometric view of a hanger attachment in accordance with the present invention.
Figure 1B:
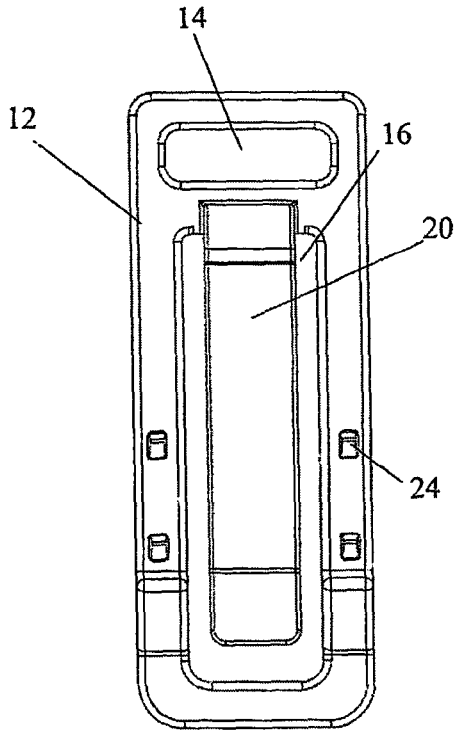
FIG. 1*b* is a front view of the hanger attachment of FIG. 1*a;*
Figure 1C:
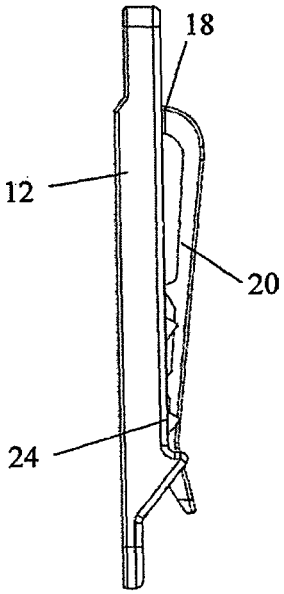
FIG. 1*c* is a side view of the hanger attachment of FIG. 1*a*

FIGS. 1*a* to 1*c* show a hanger attachment 10 for gripping a garment. The attachment 10 comprises a boarder 12 with a slot-shaped connection aperture 14 at one edge of the boarder 12 and a secondary aperture 16 within the boarder 12. Immediately below the connection aperture 14, an extension section 18 protrudes from the boarder 12 and a resilient rectangular gripping tongue 20 is attached substantially perpendicularly to the extension section 18, such that the tongue 20 is angled towards the secondary aperture 16. In a rest position, the resilient tongue 20 may be received into the secondary aperture 16 or it may be close thereto. This provides a tight gripping mechanism when the device 10 is used to engage part of a garment.

The intended underside of the tongue 20, that is, the side that faces the secondary aperture 16, is provided with a plurality of gripping teeth 22 arranged across the tongue 20 and spaced therealong. The boarder 12 is also provided with gripping teeth 24 arranged to extend from the boarder 12 in the direction towards the tongue 20. The teeth 22 and 24 are angled on their side opposite from the extension section 18. This aids with passing garments over the teeth 22 and 24 and under the tongue 20. The other side of the teeth 22 and 24 is substantially perpendicular to the boarder 12 and the tongue 20 in order to grip more securely.

When in use, the attachment 10 fixes onto a hanger using connection aperture 14 and a garment is pushed between the tongue 20 and the boarder 12, over the teeth 22 and 24. As the garment is push into the attachment, the tongue 20 yields to allow the garment in. The tongue 20 then attempts to return to its original position, due to its resilience and it exerts a force on the garment to grip it between the tongue 20 and the boarder 12. The teeth 22 and 24 assist in gripping the garment and reducing the likelihood of it being released.

Figure 2:
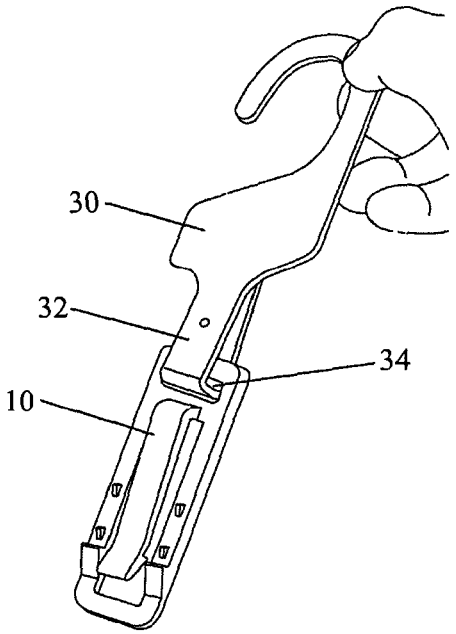
FIG. 2 is a diagram of an assembly of a hanger and the hanger attachment of FIGS. 1*a* to 1*c;*
Figure 3:
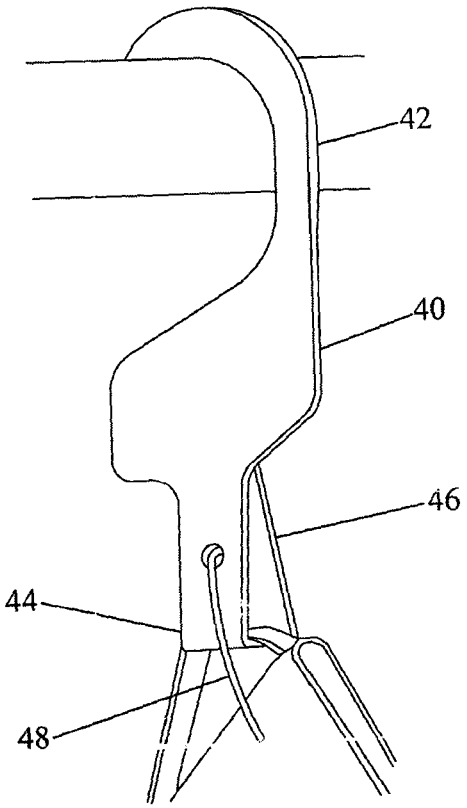
FIG. 3 is a view of a hanger and connector in accordance with the present invention.
Figure 4:
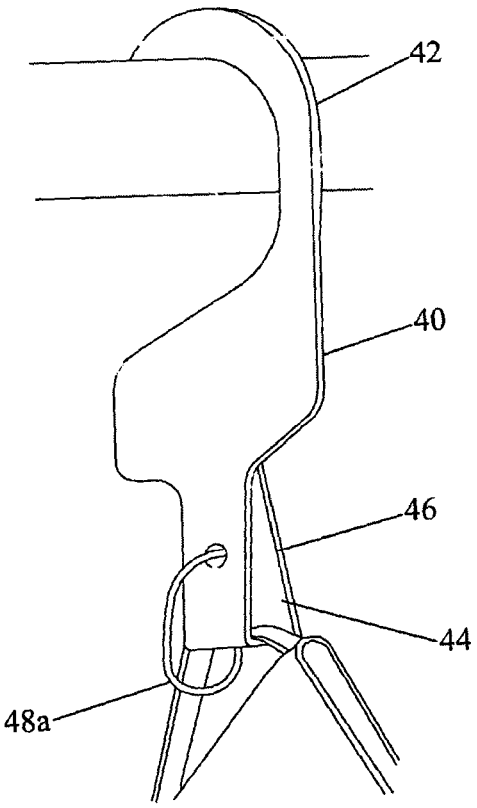
FIG. 4 is a view of a further hanger and connector in accordance with the present invention.

FIG. 2 shows an attachment device 10 connected to a hanger 30. The hanger 30 has an elongate part 32 that folds to form a loop having and substantially flat spacer 34 at its intended lower end. The elongate part 32 is fed through the attachment 10 and then connected to the hanger 30 so that the attachment 10 is retained on the hanger. The elongate part 32 may also be fed through a belt loop on a garment, as shown in FIGS. 3 and 4 in relation to another aspect of the present invention. In such an arrangement, the belt loop could be fed onto the elongate part 32 first and the attachment 10 applied thereafter. The loop of the hanger 30 is then closed and part of the garment is fed into the attachment 10 to retain it. The garment can this have its drop height reduced by using the attachment 10.

Where the garment is a pair of jeans, the leg of the jeans is folded and the thigh, knee or shin region of the legs of the jeans is placed into the gripping mechanism of the attachment. This reduces the overall drop height and allows the garment to still be hung from the waistline by the hanger.

FIG. 3 shows a hanger 40 comprising a rail engaging portion 42 and a deformable elongate member 44. The end of the elongate member 44 distal from the rail engaging portion 42 comprises a first part of a connection mechanism such that the elongate member can be deformed back upon itself and connected to a second part of the connection mechanism of the hanger to form a loop. The second part of the connection mechanism is on the back of the hanger.

The elongate member of the hanger 40 comprises three predetermined weakened regions along which the elongate member deforms to form the loop. At the same time as forming the loop, a substantially flat spacer is formed at the intended lower end of the loop.

The hanger 40 is provided with an aperture 46 within the material from which it is constructed, which although shown as being in the elongate member 44, may be positioned anywhere on the hanger 40. The material of the hanger is effectively punctured to create the aperture, although it may be formed during the moulding process. This results in a relatively small aperture through which a tie may be threaded such that the hanger may be connected to a garment.

The elongate member 44 is threaded through the loop of a garment and the connection mechanism is secured to form a loop having a spacer upon which the garment rests. A tie 48, in the form of a flexible length of plastics material, also known as a "kimble", is threaded through the aperture 46 and through the garment. The kimble 48 comprises a thin length of plastics material with barbs at each end to prevent it becoming readily disengaged. The tie 48 attaches the hanger 40 to the garment so that they are connected in a relatively secure manner. This prevents the hanger from becoming separated from the garment. When the garment is purchased, the tie 48 can be removed and the hanger taken off the garment.

The garment may be folded and the hanger 40 threaded through two belt loops. In such a situation, to try on the garment, a customer can disconnect the connection mechanism of the loop of the hanger 40 and slide the elongate member 44 back through the loops of the garment. The customer can then try on the garment but the hanger 40 remains attached to the garment so that the size label is not removed. The hanger can then be threaded back through two belt loops and reconnected to hang the garment. By folding the garment and threading the hanger through two belt loops, the garment can take up less space. However, with the hanger been attached to the garment, it is not easily lost and applied to a different garment.

FIG. 4 shows an arrangement similar to that shown in FIG. 3, wherein the flexible tie 48*a* comprises a loop of material that is connected to itself and passes through the loop of the garment too.

Figure 5:
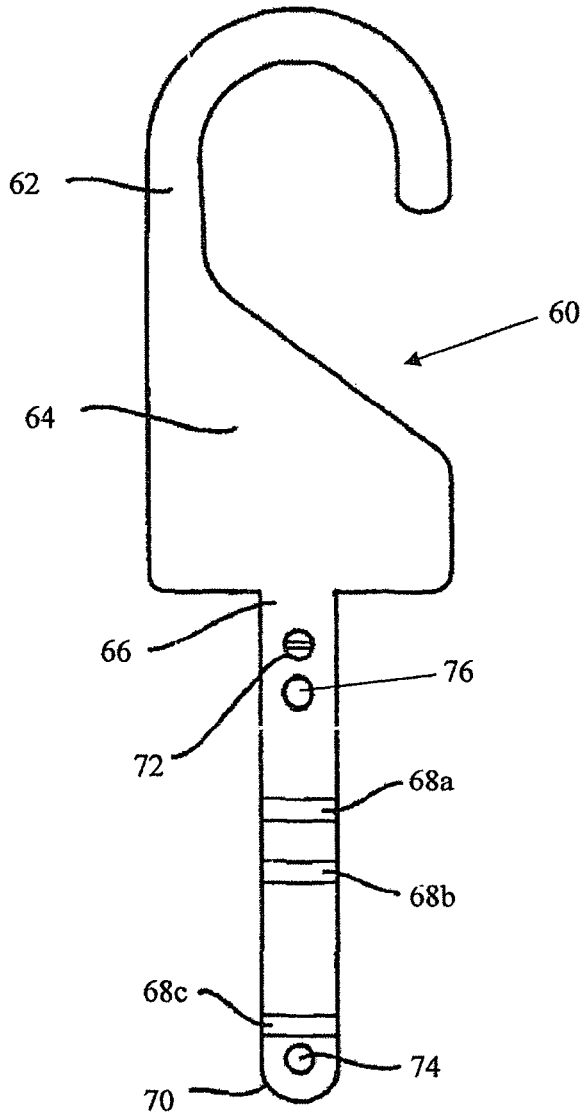
FIG. 5 is a hanger in accordance with the present invention.

FIG. 5 shows a garment hanger 60 in accordance with the present invention and that may be used in the hanger assemblies of the present invention. The hanger 60 comprises a rail engaging portion 62 in the form of a hook. The rail engaging portion 62 is connected to a body section 64, which is in turn connected to an elongate garment engaging portion 66. The elongate portion 66 comprises three weakened regions 68. The distal end of the elongate portion 66 is provided with one part 74 of a connection mechanism and the proximal end of the elongate portion 66 is provided with another part 72 of the connection mechanism. The two parts of the connection mechanism can be releasably joined. The elongate portion 66 may be folded, for first two of which 68*a* and 68*b* fold inwardly to create a substantially flat spacer, or shelf, on which a garment may rest when in use, as shown in the previous figures. The third weakened region 68*c* folds backward to reduce the stress on the connection member 72 and 74. In its folded position with the connection members 72 and 74 joined, the elongate portion 66 forms a closed loop. A connection hole 76 is provided in the elongate portion, although it may be provided at any position on the hanger 60. The connection hole 76 allows one to connect the hanger to a garment by threading a tie through the hole and attaching the tie to the garment.

Where the hanger of the present invention does not need connecting to the garment independently of the garment engaging means, the connection hole 76 may be omitted. This may be useful when using the hanger attachment but not connecting the hanger to the garment using connection means separate from the garment engaging element. Additionally, the rail engaging portion may be connected directly to the elongate portion without the need for a body section.

The attachment and the hanger may both be formed of plastics material and/or metal. Preferably, the attachment comprises a relatively rigid plastics material, such as polystyrene so that it is fairly rigid but has some yieldability. The attachment may be substantially rigid, although it may be desirable for it to comprise a flexible portion between the connection aperture and the gripping section.

The hanger assembly may be an integral moulding rather than being two separate parts. In such an arrangement the gripping section is moulded onto the body of the hanger rather than being a separate part that is connected to the hanger.

It may be desirable to attach a security tag, such as an RFID security tag, to the hanger. Because the hanger may be substantially permanently connected to the garment until it is sold, the security tag will also be attached thereto. In one arrangement, the security tag may be overmoulded into the plastics material of the hanger itself.

Hanger may be attached to the garment using a pin or other non-flexible retaining means.

The attachment for reducing the drop height could be used with clip hangers and other hanger types by sliding it over the hook portion of a hanger using the connection aperture.

A "garment" is considered to be an item of clothing that may be worn by a person. Therefore, the may be trousers, shorts, jeans, skirts, jackets, jumpers or shirts, although the list is not limited thereto. Accessories, such as hats, sunglasses and belts are not considered to be garments.

The gripping tongue may be substantially rectangular or another suitable shape, such as a quadrilateral circle, semicircle or triangle. It is preferably that the length dimension of the tongue is greater than its width.

The tie to connect the hanger to the garment may be rigid or flexible. Although it is preferred that it is flexible and of sufficient length for the hanger to be positioned clear of the garment, it may be desirable in some circumstances for the tie to be rigid.

The features of the embodiments disclosed herein may be used in combination with or in place of features of other embodiments of the invention.

The gripping section may be located immediately below, and it may be vertically in-line with, the connection aperture of the garment hanger attachment. Alternatively, it may be offset from the connection aperture.

The hanger attachment may be provided with an aperture through which connection means may pass that connect the hanger attachment to a garment. This may be used in combination with a hanger as described herein and the same connection means may pass through both the hanger and the hanger attachment.

The invention claimed is:

1. A method of using a garment and hanger assembly, comprising the steps:

(i) displaying the garment and hanger assembly in a first, display state on a display rail in a store, in which the garment and hanger assembly in the first, display state comprises:

a garment having at one least one loop;

a garment hanger having:

garment supporting means threaded through the at least one loop of the garment and supporting the garment on the garment hanger by the at least one loop when hung on the display rail in the first, display state; and attachment means attaching the garment hanger to the garment and retaining the garment on the garment hanger independently from the garment supporting means;

a rail engaging portion that engages the display rail when hung in the first, display state; and an aperture that receives the attachment means;

wherein the garment supporting means includes a deformable elongate member, an end of the elongate member distal from the rail engaging portion comprising a first part of a connection mechanism such that the deformable elongate member is threaded through the at least one loop of the garment and deformed back upon itself and connected to a second part of the connection mechanism of the hanger to form a releasable loop that is interlinked with the at least one loop and that holds the garment to the deformable elongate member by the at least one loop in the first, display state;

wherein the attachment means includes a flexible tie passing through the aperture in the garment hanger and connected to the garment, wherein the flexible tie has a length that enables the garment to be removed from the deformable elongate member for trying on the garment while the flexible tie retains the garment on the garment hanger; and wherein the releasable loop formed by the deformable member can be released to allow the garment to be tried on, and later reattached to the garment with the deformable member reconnected by being threaded through the at least one loop of the garment, all while the flexible tie retains the garment on the garment hanger even when the releasable loop is released;

(ii) obtaining the garment and hanger assembly in the store in a second, unreleased state after the garment and hanger assembly has been tried on by a potential customer in the store, wherein in the second, unreleased state, the first and second parts of the connection mechanism are disconnected, the releasable loop is released, and the elongate member is unthreaded from the at least one loop of the garment, all while the flexible tie retains the garment on the garment hanger even when the releasable loop is released;

(iii) reconfiguring the garment and hanger assembly back into the first, display state by:

(a) reattaching the deformable member to the garment by threading the deformable elongate member through the at least one loop of the garment and closing the hanger by deforming the elongate member back upon itself and connecting the second part to the first part to reform the releasable loop; and (b) rehanging the garment on the display rail or another display rail in the store by using the rail engaging portion of the hanger and supporting the garment on the hanger using the deformable member threaded through the at least one loop;

wherein each of steps (i) through (iii) are performed while the flexible tie remains attached to both the garment and the hanger.

2. The method according to claim 1, further comprising a step of:

removing the garment hanger from the garment by disengaging or cutting the flexible tie in the store at checkout.

3. The garment and hanger assembly according to claim 2, wherein the garment hanger includes a security tag that is removed during the step of removing the garment hanger from the garment at checkout.

4. The garment and hanger assembly according to claim 1, wherein a lower end of the releasable loop is formed by a flat portion of the elongate member.

5. The garment and hanger assembly according to claim 1, wherein the rail engaging portion has a span and wherein the elongate member has a width along its length that is less than the span of the rail engaging portion.

6. The garment and hanger assembly of claim 1, wherein the elongate member has a uniform width along its length.

7. The garment and hanger assembly of claim 1, wherein the elongate member has at least two predetermined weakened regions along which the elongate member deforms to form the releasable loop.

8. The garment and hanger assembly of claim 7, wherein a portion of the elongate member between the predetermined weakened regions is flat and located at a lower end of the releasable loop.

9. The garment and hanger assembly of claim 1, wherein the aperture in the garment hanger is located on a portion of the deformable member.

10. The garment and hanger assembly of claim 1, wherein the flexible tie is formed as a loop and is secured to the garment by being threaded through the at least one loop of the garment through which the deformable member is attached.

11. The garment and hanger assembly of claim 1, wherein the garment is a pair of trousers, a pair of shorts, a pair of jeans, or a skirt; and wherein the at least one loop is a belt loop.

12. The garment and hanger assembly according to claim 1, wherein the flexible tie is selected from a group consisting of: a kimble tag; a string; and a wire.

13. A method of using a garment and hanger assembly, comprising:

(i) obtaining the garment and hanger assembly from a display rail in a store, in which the garment and hanger assembly comprises:

a garment having at one least one loop;

a garment hanger having:

garment supporting means threaded through the at least one loop of the garment and supporting the garment on the garment hanger by the at least one loop when hung on the display rail; and attachment means attaching the garment hanger to the garment and retaining the garment on the garment hanger independently from the garment supporting means;

a rail engaging portion that engages the display rail when hung; and an aperture that receives the attachment means;

wherein the garment supporting means includes a deformable elongate member, an end of the elongate member distal from the rail engaging portion comprising a first part of a connection mechanism such that the deformable elongate member is threaded through the at least one loop of the garment and deformed back upon itself and connected to a second part of the connection mechanism of the hanger to form a releasable loop that is interlinked with the at least one loop and that holds the garment to the deformable elongate member;

wherein the attachment means includes a flexible tie passing through the aperture in the garment hanger and connected to the garment, wherein the flexible tie has a length that enables the garment to be removed from the deformable elongate member for trying on the garment while the flexible tie retains the garment on the garment hanger; and wherein the releasable loop formed by the deformable member can be released to allow the garment to be tried on, and later reattached to the garment with the deformable member reconnected by being threaded through the at least one loop of the garment, all while the flexible tie retains the garment on the garment hanger even when the releasable loop is released; and (ii) trying on the garment and hanger assembly in the store by:

(a) releasing the releasable loop by disconnecting the first and second parts of the connection mechanism;

(b) unthreading the elongate member from the at least one loops of the garment; and (c) putting on the garment while the flexible tie retains the garment hanger on the garment.

14. The method according to claim 13, wherein after the step (ii) of trying on the garment and hanger assembly in the store, the method further comprises a step of:

(iii) reattaching the deformable member to the garment by threading the deformable elongate member through the at least one loop of the garment, and closing the hanger by deforming the elongate member back upon itself and connecting the second part to the first part to reform the releasable loop.

15. The method according to claim 14, wherein after the step (iii) of reattaching, the method further comprises a step of:

(iv) hanging the garment on the display rail or another display rail in the store by using the rail engaging portion of the hanger and supporting the garment on the hanger using the deformable member threaded through the at least one loop, all while the flexible tie remains attached to both the garment and the hanger.

16. The method according to claim 13, further comprising a step of:

removing the garment hanger from the garment by disengaging or cutting the flexible tie in the store at checkout.

17. The garment and hanger assembly according to claim 16, wherein the garment hanger includes a security tag that is removed during the step of removing the garment hanger from the garment at checkout.

* * * * *